US005104256A

United States Patent [19]

D'Avela

[11] Patent Number: 5,104,256

[45] Date of Patent: Apr. 14, 1992

[54] LOW PROFILE PAVEMENT MARKER

[75] Inventor: Canan D'Avela, Yuma, Ariz.

[73] Assignee: Highway Ceramics, Inc., Yuma, Ariz.

[21] Appl. No.: 599,060

[22] Filed: Oct. 17, 1990

[51] Int. Cl.[5] ..... E01F 9/06; G02B 5/126

[52] U.S. Cl. ..... 404/14; 359/531; 359/534

[58] Field of Search ..... 404/12-16, 404/9; 350/102, 103, 104; 116/63 R

[56] References Cited

U.S. PATENT DOCUMENTS

| | | | |
|---|---|---|---|
| 3,499,371 | 9/1970 | Jonnes et al. | 404/14 X |
| 3,922,066 | 11/1975 | Schaefer | 404/14 X |
| 4,428,320 | 1/1984 | Oplt et al. | 404/14 X |
| 4,753,548 | 6/1988 | Forrer | 404/15 |

FOREIGN PATENT DOCUMENTS

| | | | |
|---|---|---|---|
| 178010 | 11/1982 | Japan | 404/14 |
| 2140850 | 12/1984 | United Kingdom | 404/15 |
| 2190123 | 11/1987 | United Kingdom | 404/16 |

*Primary Examiner*—David J. Bagnell
*Attorney, Agent, or Firm*—Timothy T. Tyson

[57] ABSTRACT

A low profile pavement marker (30) for bonding to a pavement with an adhesive for marking traffic lanes and areas is described. The marker has a smooth upper reflective surface (36) which scatters overhead light in all horizontal directions for daytime visibility and a vertical retroreflective strip (42) for reflecting incident light to its source for nightime visibility. The marker (30) has a lip bonded to its base (34) to keep the pavement adhesive away from the retroreflective strip (42) which allows the strip to be located adjacent to the pavement. This, in turn, allows for the low profile and the optimal vertical placement of the retroreflective strip (42). A visor (46) extends smoothly outward from the upper surface (36) and protects the retroreflective strip (42) from tire abrasion. A clear coating (44) protects the retroreflective strip (42) from moisture and ultraviolet radiation. Other embodiments are also provided.

49 Claims, 5 Drawing Sheets

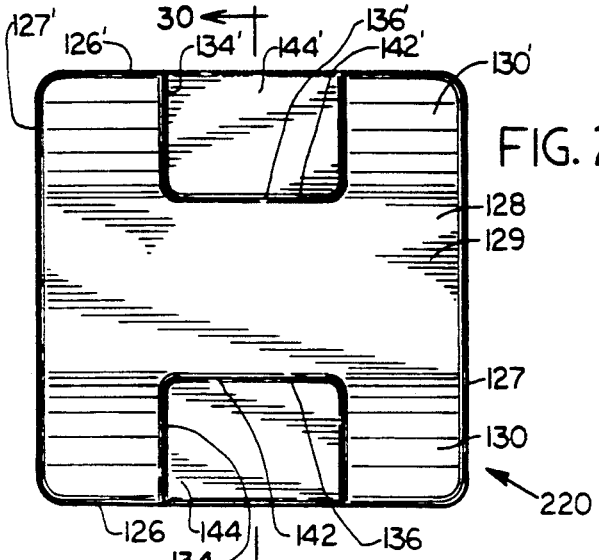
FIG. 26
FIG. 27
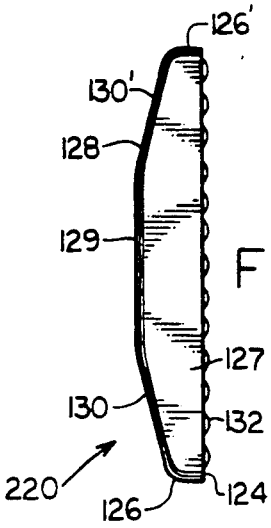
FIG. 28
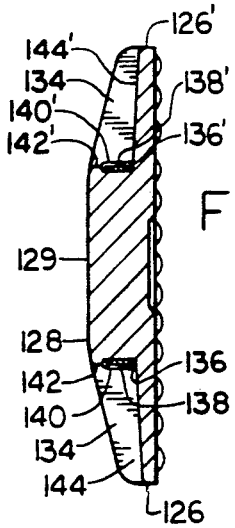
FIG. 30
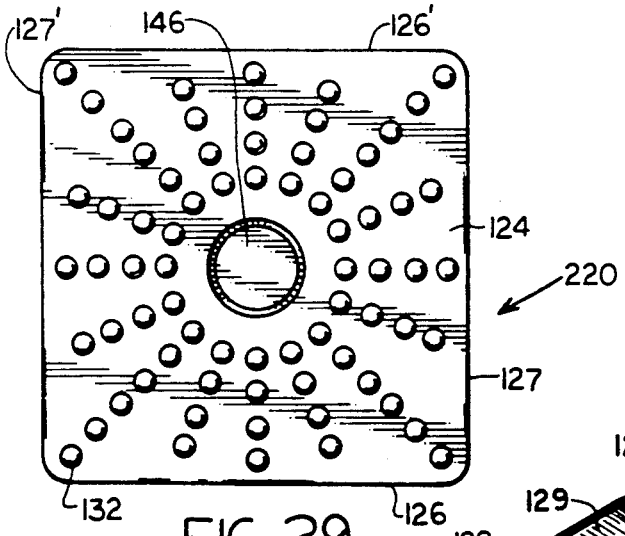
FIG. 29
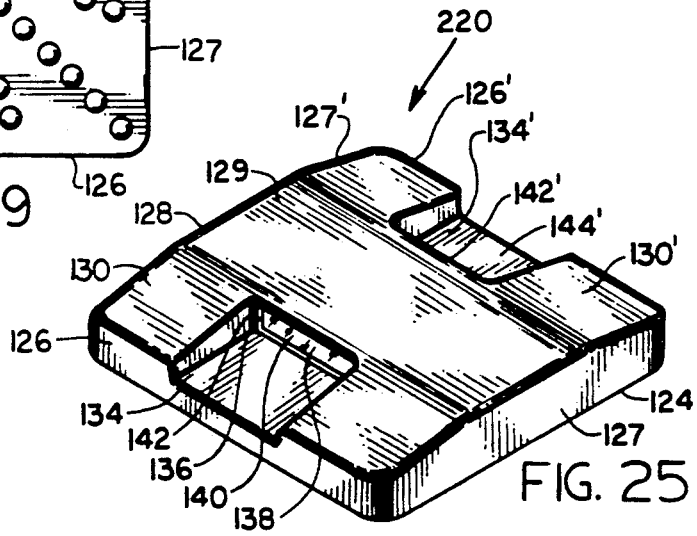
FIG. 25

LOW PROFILE PAVEMENT MARKER

TECHNICAL FIELD

The present invention pertains to pavement markers for delineation of traffic lanes and areas, and more particularly, to reflective ceramic pavement markers having retroreflective elements and intended for bonding to a pavement with an adhesive.

BACKGROUND ART

Pavement markers for the delineation of traffic lanes on automobile highways or airport landing strips and traffic areas in parking zones are a common article of manufacture in modern life. The requirements for this common item are, however, quite demanding.

A pavement marker should be highly visible to an oncoming motorist or pilot during the daytime when ambient light strikes the marker from all directions. Most of the light at this time is coming from overhead and the source is, of course, the sun. On the other hand, the marker must retain its visibility at night when the dominant direction of the light coming to the marker is from the direction of the observer and the source is the headlights of the observer's vehicle.

In order to be visible in the first situation the marker must be highly reflective and scatter the overhead light parallel to the ground surface since that is usually where the observer will be located. In the latter case the marker must be retroreflective which, as might be surmised from the Latin word *retro* meaning backward, refers to a device that returns light to its source. It follows from this concept that a totally retroreflective marker is a poor performer during the day because the reflected light would be directed towards the sun rather than towards an observer. Similarly, a purely reflective marker is a poor performer at night since it tends to scatter the light from a single source.

In addition to being highly visible, a pavement marker must also warn the vehicle operator of its presence by the senses of touch and hearing. This requirement comes into play when the vehicle wheels inadvertently, or otherwise, contact the marker. This situation must not result in damage to the vehicle; instead, the marker physical design must cause a combination of vibration and sound that alerts the operator of the vehicle to his location relative to a traffic lane, pedestrian safety zone or the like. Not only must this situation not cause vehicle damage but the impact must not be so abrupt as to unduly startle the operator or transfer a force to the steering wheel that would result in loss of control.

Markers are usually mounted to the surface of the road or runway with an adhesive. The design of the marker must provide a relatively broad base that has vertical and horizontal surfaces to which the adhesive can cling so that the marker does not move after the adhesive cures.

In addition the design must anticipate that markers are installed by the hundreds and thousands and the installer does not have the time to take unusual care with this process. Therefore, the marker may be pressed hurriedly and forcibly into the adhesive with the result that adhesive may well upward along the marker sides. This may obscure some of the reflective surface. More importantly, since the retroreflective surface is often close to the mounting surface of the marker in order to gather and reflect light from approaching headlights, a large part of this surface may be obscured. The marker design, thus, should tend to deflect the upward welling adhesive away from the retroreflective surfaces of the marker.

Most retroreflective materials are less durable than reflective surfaces such as glazed ceramic and require some protection from the impact and abrasion of vehicle tires. A complete marker provides such protection.

The marker must be durable. It must live in the hostile environment of rain, snow, hot and cold cycles, and the impact of vehicle tires and survive; not only survive but keep its reflective qualities despite the abrasive contact of tires. The design must be such as to inhibit the buildup of dirt and debris that would obscure the marker and, instead, facilitate the cleaning away of these materials by the impact and wiping motion of vehicle tires.

Finally, because of the great number of markers required for delineation of highway lanes and other applications, the marker design must be economical to produce.

Since at least some of these parameters place conflicting demands upon the marker design, all inventions are compromises to some extent. One marker invention is U.S. Pat. No. 3,332,327 to Heenan. This invention utilized corner reflectors molded into the inner wall of a hollow structure which was then filled with an epoxy compound to provide strength. Corner reflectors are open devices composed of three mutually perpendicular walls. If the walls are perfectly flat and precisely perpendicular to each other, any entering radiation, whether in the microwave portion of the spectrum or the visible light portion, will be returned in the direction of the source. This makes a useful structure for range testing of radar systems or returning incident light from a lane marker. The light reflecting properties of corner reflectors are discussed in U.S. Pat. No. 1,906,655 to Stimson.

U.S. Pat. No. 3,938,903 to Montgomery describes the use of circular studs on the pavement contacting base of a marker to provide an adequate surface for the adhesive to successfully hold the marker to the pavement.

Montigny in U.S. Pat. No. 4,008,973 has a low profile marker with protected retroreflective structures. Heenan in U.S. Pat. No. 4,208,090 proposes a compromise between corner reflectors and flat surfaces which are superior for daytime reflection purposes. U.S. Pat. No. 4,653,955 to Racs calls for the use of a retroreflective strip bonded to the sides of a circular marker. Heasley in U.S. Pat. No. 3,980,393 combines the corner reflector concept with a convex and concave lens structure which protects the corner reflector structure. U.S. Pat. Nos. 4,232,979 and 4,340,319 to Johnson and Heenan involved the use of abrasion resistant untempered glass sheet for protection of such corner reflectors. Forrer in U.S. Pat. Nos. 4,753,548 and 4,797,024 describes the use of a polymerizable acrylic protective covering for a retroreflective lens. Design patents U.S. Pat. No. Des. 215,376 and U.S. Pat. No. Des. 225087 to Haley illustrate two possible design outlines for lane markers.

Some of these inventions are complex and rather expensive to produce or are specialized for nightime use only. Others are larger than necessary to provide visual and vibration feedback to the vehicle operator. Others have no provisions for preventing flow of adhesive over the retroreflective surface.

Thus, a pavement marker that combines good daytime and nightime reflectivity, provides abrasion protection for the retroreflective material, has a low smooth profile so as to not induce excessive shock and vibration to vehicle wheels, can be set into pavement adhesive without having its surfaces obscured and is simple and economical to produce would be of considerable utility.

DISCLOSURE OF INVENTION

In accordance, therefore, with an embodiment of the present invention a low profile pavement marker is provided. The marker is circular in cross section and the circular cross section diameter rapidly reduces as the cross section rises from the base of the marker. The upper surface of the marker is terminated at one side by a wall that is substantially normal to the base. A retroreflective strip is bonded to this vertical wall and is covered with a clear coating for protection from moisture and ultraviolet (UV) radiation.

For protection of the retroreflective strip from abrasion of tires a visor extends from the upper surface of the marker over the strip. For protection from the obscuring effects of the bonding used to hold the marker to the pavement, a lip is provided at the base of the marker. Since this lip extends beyond the vertical wall the adhesive, at the time the marker is installed on the pavement, is pressed outward away from the retroreflective strip.

The upper surface of the marker may have a constant circular cross section in the area immediately adjacent the base so as to also prevent bonding material from obscuring the sloping reflective sides.

The vertical wall, viewed from the base, may be linear, concave or convex. Thus the retroreflective strip may be contoured for special applications depending upon the location of the source of the illumination and the location of the observer. The base of the marker has a pattern of circular studs extending downward and a central depression. This provides an excellent surface for the adhesive used to cement the marker to the pavement. The circular studs and central depression allow for resistance to forces applied to the marker from any direction.

The retroreflective strip is placed vertically and close to the pavement. This is made possible by a protective lip that prevents pavement adhesive from welling up and obscuring the strip. In another embodiment a tab descends from the vertical wall to perform this function. This allows the marker to be low in profile which allows for an adequate but not excessive auditory and tactile feedback to the vehicle operator when the wheels run over the marker. The design presents nearly the same profile in all directions. Vertical is the optimum orientation for the strip as this places it virtually normal to the nightime illumination source. In many markers the retroreflective element is placed at an angle because it is so large that a vertical orientation would present too large an obstacle for the vehicle wheels. Consequently the strip reflects less of the incident light in the direction of the observer.

The retroreflective strip is well protected from moisture and UV radiation by the clear coating and is protected from tire abrasion by the upper surface visor. At the same time the smooth contours do not create opportunities for accumulation of dirt and debris. The same contours allow for a wiping action by tires that cross the upper surface. This action tends to clean the marker.

For those situations requiring a retroreflective strip facing in opposite directions another embodiment of the present invention is provided with a similar shape but with a second vertical wall facing opposite to the first wall. This embodiment of the marker is somewhat elongated in order to compensate for the loss of base area due to the second wall.

In both of the above embodiments a shock inhibiting protective cap or coating may be bonded to or imbedded into the upper surface above the visor or across the upper surface. This strip or area may have tiny embedded micro glass beads for additional nightime retroreflection.

In accordance with another embodiment of the present invention a larger marker with two vertical retroreflective strips facing in opposite directions is provided. This marker also arranges for the optimum orientation of the strips but presents a slightly larger profile vertically and horizontally for those situations requiring a greater auditory and tactile feedback through overpassing wheels.

Although all embodiments may be made of various materials such as ceramics, plastics, composites, metals and alloys, they are best made of a high glaze ceramic for long life and maintenance of reflective qualities. Ceramic construction eliminates rust and corrosion due to environmental conditions.

The novel features of the invention are set forth with particularity in the appended claims. The invention will be best understood from the following description when read in conjunction with the accompanying drawings.

BRIEF DESCRIPTION OF DRAWINGS

Incorporated as part of the description, in order to illustrate embodiments and principles of the present invention, are the accompanying drawings, wherein:

FIG. 25 is a perspective view in accordance with another preferred embodiment of the present invention;

FIG. 26 is a top plan view;

FIG. 27 is a front elevation view;

FIG. 28 is side elevation view;

FIG. 29 is a bottom plan view.

FIG. 30 is a sectional view along the line 30—30 of FIG. 26; and

MODES FOR CARRYING OUT THE INVENTION

All retroreflective means described herein are intended to have the ability to act on a singular source of light and/or a plurality of light sources simultaneously thereby retoreflecting light back to a source and/or several sources or nearby these sources at any moment.

Figure 1:
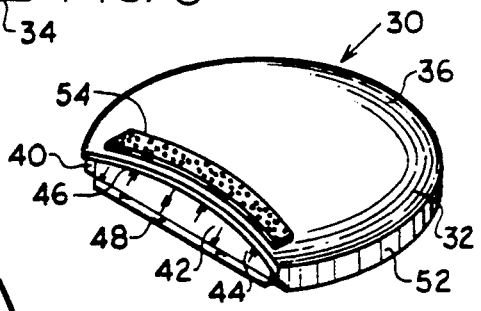
FIG. 1 is a perspective view in accordance with a preferred embodiment of the present invention.

FIG. 1 is a perspective view illustrating, in accordance with one embodiment of the present invention, a pavement marker 30 having a body 32 with a base 34, a vertical side 52 and an arcuate upper surface 36.

Figure 2:
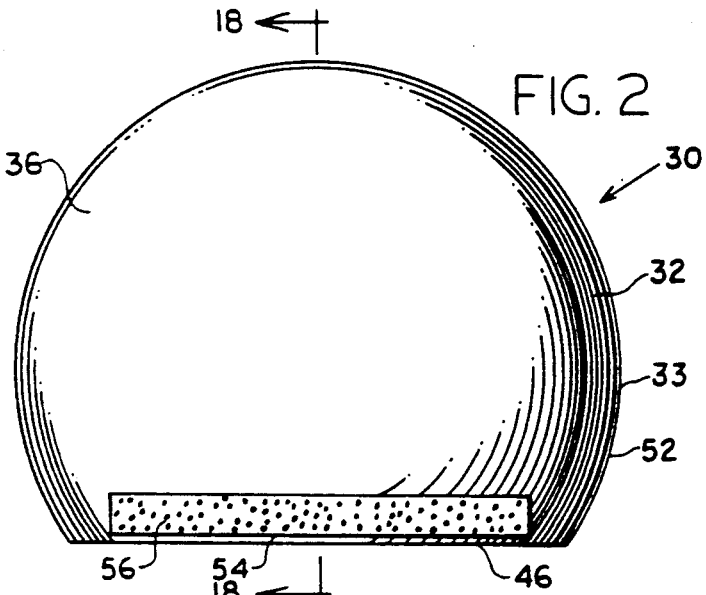
FIG. 2 is a top plan view.
Figure 3:
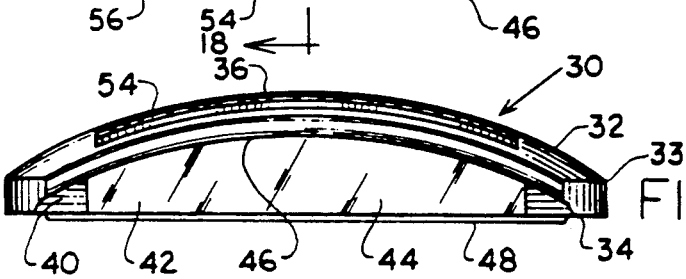
FIG. 3 is a front elevation view.

As illustrated in FIG. 2, which is a top plan view of the marker 30, the side 52 is substantially circular in cross section but it and the upper surface 36 are terminated at an edge 33 of the body 32. In the front elevation view of FIG. 3 and the side elevation view of FIG. 4, the termination of the side 52 and the upper surface 36 is seen to be accomplished by a substantially vertical wall 40. A retroreflective strip 42 such as REFLEXITE from Reflexite Corporation of New Britain, Conn., is bonded to the wall 40 by means of the pressure sensitive glue supplied on the back of the product by the manufacturer and a clear protective coating 44, with an ultraviolet (UV) inhibitor, such as PPG Deltron #DCU-8200 manufactured by PPG Industries Incorporated of Strongsville, Ohio is applied over the retroreflective strip 42 thereby coating strip 42 and filling the edge and slight crack around the strip 42 with the coating 44 to protect the pressure sensitive adhesive on the back of the strip 42 from the environment and to create a mechanical connection between the coating 44 and the wall 40. Apparent in these figures and also in FIG. 5, which is a bottom plan view, is a visor 46 which extends from the upper surface 36 over the wall 40 and the attached retroreflective strip 42. Bonded to the base 34, or as an integral part of the base, is a lip 48 which also extends outward past the wall 40 and retroreflective strip 42.

Retroreflective materials are designed to reflect the light from a vehicle's headlights back to the driver of the vehicle at night in order to alert him of a lane location, a curve in the road or other road hazard. The retroreflective strip of the present embodiment is most efficient if it is vertical or nearly so since the light source and the driver's eyes are near the pavement surface. A retroreflective strip angled substantially upwards would reflect a portion of the incident light uselessly up to the sky.

Markers are mounted to the pavement with an adhesive which often wells upwards as the marker is pressed down into the adhesive. This may cause the adhesive to bond to and obscure part of the retroreflective strip. The protective lip 48 presses the adhesive away from the retroreflective strip 42 and thus allows the strip 42 to be located immediately adjacent to the base 34. This location permits the use of a vertical retroreflective strip 42 since the profile of the marker will still be low enough to not induce undue vibration in vehicle wheels passing over it.

Retroreflective strips need protection from the damaging effects of moisture, the aging effects of UV radiation, the abrasive effects of tires and the impingement of sand, gravel, and other road debris. The clear coating 44 provides protection from such damaging effects. Such a coating is preferable to a glass shield which does not block UV radiation. The visor 46 provides protection from vehicle tires. The visor 46 forms part of the rounded contour of the upper surface 36 which allows tires to pass smoothly overhead.

Figure 4:
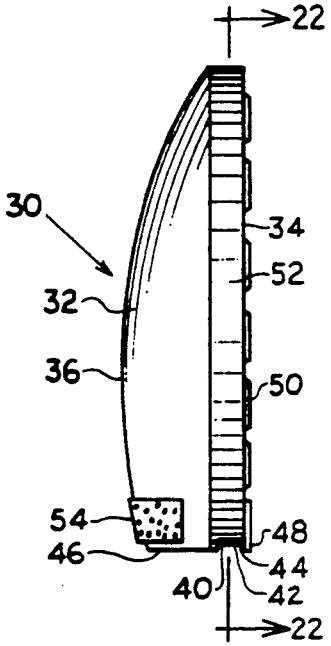
FIG. 4 is side elevation view.

A resilient cap 54, which is best seen in FIGS. 2 and 4, is bonded to the upper surface 36 adjacent the visor 46 and provides additional protection against the shock of vehicle tires. The cap 54 has embedded micro glass spheres 56 to enhance the retroreflective qualities of the marker 30 at night. A glass sphere is an efficient retroreflective device. Other shapes for the cap 54, such as a triangle, circle or square, may be used rather than the rectangular strip illustrated.

Figure 5:
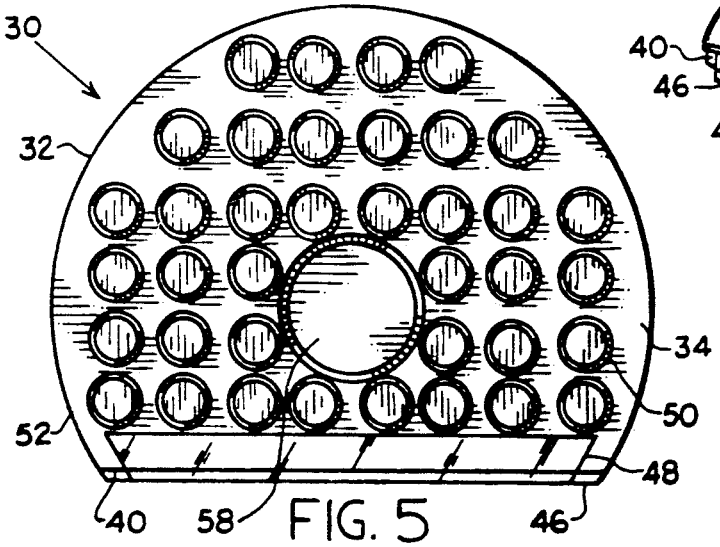
FIG. 5 is a bottom plan view.

Illustrated in FIG. 5 are a plurality of circular studs 50 which descend from the base 34. These studs provide a gripping surface for the pavement adhesive to adhere to. A shallow depression 58 is left in the middle of the base 34 to allow room into which the adhesive may flow to further enhance the adhesion.

Figure 6:
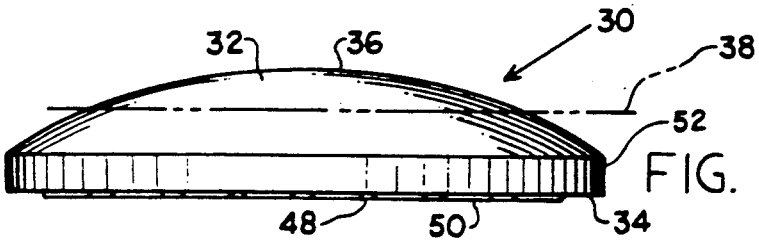
FIG. 6 is a rear elevation view.

It can be appreciated from FIG. 2 and the rear elevation view of FIG. 6 that the upper surface 36 has a substantially circular cross section along any line 38 that is parallel to the base 34. The diameter of this cross section continuously decreases with increasing distance from the base 34. When the marker 30 is constructed of a durable ceramic material with a high glaze on the upper surface 36, daytime light falling from above is scattered from the circular descending upper surface 36 along the ground surface in all directions. This makes the marker 30 highly visible to vehicle operators during the day while the vertical retroreflective strip 42 provides excellent night time visibility.

The marker 30 thus provides a marker with a highly reflective upper surface 36 for day time visibility, an efficient vertical retroreflective strip 42 (with moisture and UV protection from the clear coating 44) for night time visibility, a visor 46 and a lip 48 for protection from tire abrasion and upwelling pavement adhesive, studs 50 and depression 58 for pavement adhesive bonding, a cap 54 for shock protection and increased nightime visibility, and a smooth low profile formed by the upper surface 36 and the contiguous visor 46 for adequate but not damaging auditory and tactile feedback to the vehicle driver.

Figure 7:
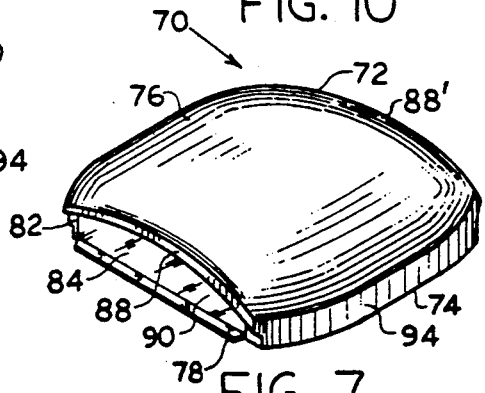
FIG. 7 is a perspective view in accordance with another preferred embodiment of the present invention.

FIG. 7 is a perspective view which illustrates, in accordance with another embodiment of the present invention, a marker 70. The marker 70 has two opposed vertical walls 82, 82' (best seen in FIG. 10), each with an attached retroreflective strip 84, 84' and a clear coating 90, 90' overlying the strip for protection against moisture and UV radiation. This makes the marker 70 useful for those situations requiring good night time visibility in two opposing directions. Such a situation might be the center dividing line in a two way street or highway in which it is desirable to alert drivers approaching from opposite directions.

Figure 8:
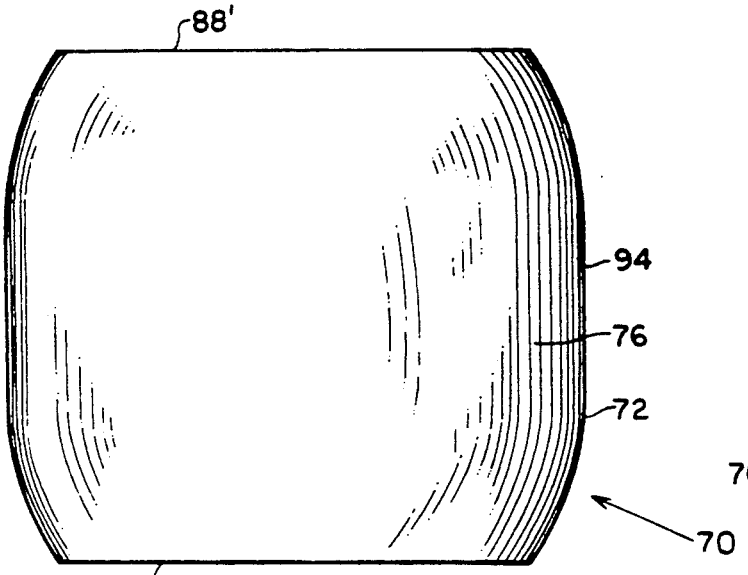
FIG. 8 is a top plan view.
Figure 10:
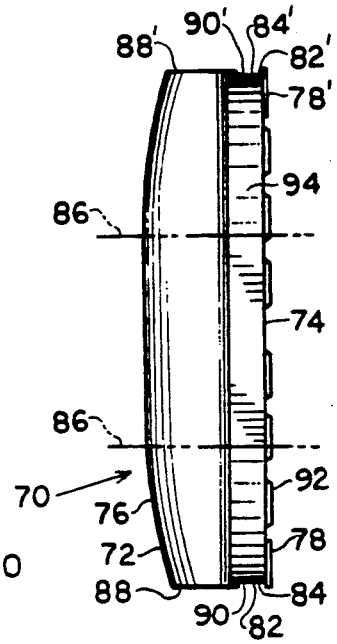
FIG. 10 is side elevation view.
Figure 9:
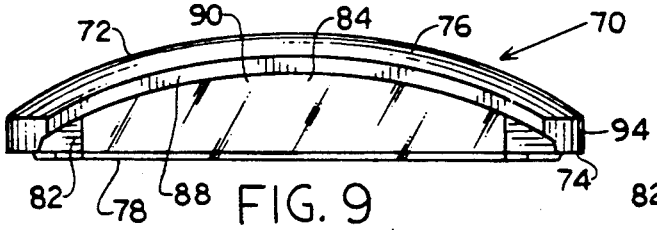
FIG. 9 is a front elevation view.
Figure 11:
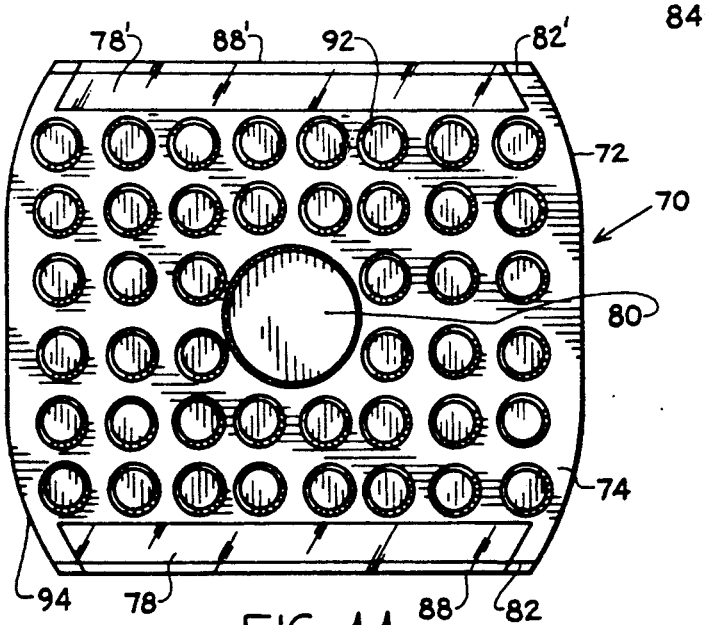
FIG. 11 is a bottom plan view.

As can be seen in the top plan view of FIG. 8, the front elevation view of FIG. 9, the side elevation view of FIG. 10 and the bottom plan view of FIG. 11, the marker 70 shares the other features of the marker 30 (FIG. 1) such as abrasion protective visors 88, 88', adhesive protective lips 78, 78', adhesive adherence circular studs 92 and depression 80 on a base 74, and a smooth low profile formed by a relatively arcuate upper surface 76 and contiguous visors 88, 88'. The shallow depression 80 in the base 74 allows space for the flow of excess pavement adhesive to further enhance the adhesion.

The presence of two vertical walls 82, 82' removes base surface area from the marker 70. To insure sufficient base area, with studs 92 and depression 80, for pavement adhesive adherence, the body 72 of the marker 70 is elongated relative to the marker 30. This elongation is apparent in FIGS. 8 and 10 and is accomplished by the insertion of a section between the lines 86 (FIG. 10) in which the upper surface 76 cross section, along the lines 86, remains constant and substantially equivalent to the upper surface cross section through the center of the marker 30 (the cross section along a line normal to the base 34 and through the center of the circular side 52 in FIGS. 2 and 4). The cross section outside of the lines 86 is similar to that of the cross section through the marker 30 as it leaves the center.

Although it is not shown in FIGS. 7 through 11, the marker 70 may have a resilient cap similar to the cap 54 with embedded micro glass spheres that is used in the marker 30 (visible in FIG. 1). These caps may be bonded or be an intergral part of the upper surface 76 adjacent to the visors 88, 88' and may vary in size to cover a part of or substantially all of the upper surface 76.

In addition to the retroreflective strips 84 facing in opposing directions, the marker 70 of FIGS. 7 through 11 includes the other features and advantages of the previously described marker 30 of FIGS. 1 through 6.

Figure 13:
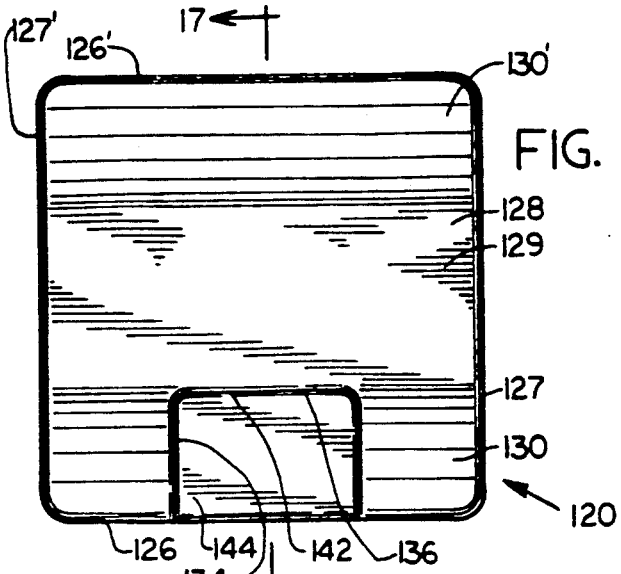
FIG. 13 is a top plan view.
Figure 15:
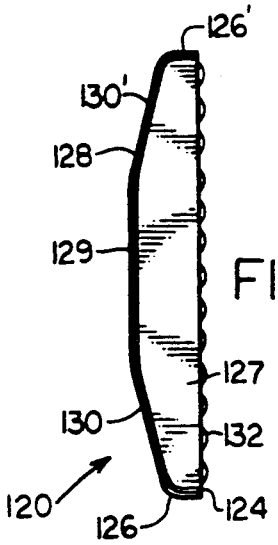
FIG. 15 is side elevation view.
Figure 14:
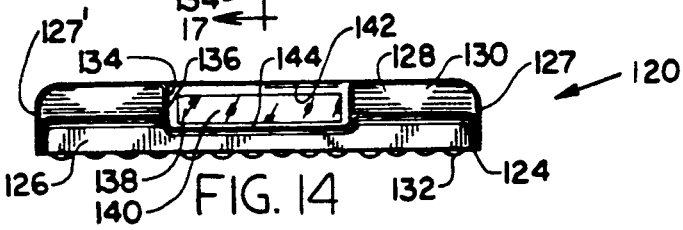
FIG. 14 is a front elevation view.
Figure 17:
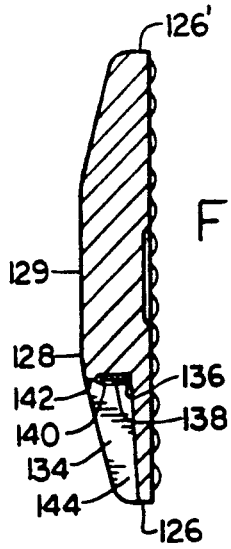
FIG. 17 is a sectional view along the line 17—17 of FIG. 13
Figure 12:
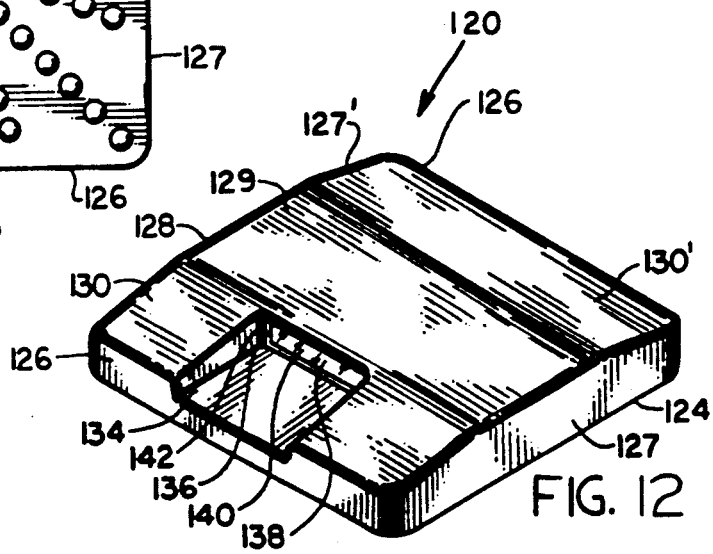
FIG. 12 is a perspective view in accordance with another preferred embodiment of the present invention.

Another embodiment of the present invention is illustrated in the perspective view of FIG. 12 of the marker 120. The marker 120 has substantially vertical opposing sides 126, 126' and opposing sides 127, 127' that rise from a rectangular base 124 to an upper surface 128. It can be seen in the top plan view of FIG. 13 and the side elevation view of FIG. 15, of the marker 120, that, in the two opposing sides 126, 126', ramps 130, 130' slope upwards from the sides 126, 126' to the top 129 so that the upper surface 128 includes the top 129 and the ramps 130, 130'. It is also seen in FIG. 13 and the front elevation view FIG. 14 of the marker 120 that the ramp 130 has an indentation 134 that extends inward from the side 126 and terminates in a substantially vertical wall 136. The wall 136 is best seen in FIG. 17 which is a sectional view along the line 17—17 of FIG. 13.

A retroreflective strip 138 is bonded to the wall 136. A floor 144 fills the bottom of the indentation 134 and declines gradually from the wall 136 to the side 126. The gradual decline of the floor 144 away from the vertical wall 136 insures that moisture and debris will not accumulate adjacent to the retroreflective strip 138. A visor 142 extends outward from the upper surface 128 over the retroreflective strip 138 to protect the strip from tire abrasion. Clear coating 140 for protection from moisture and UV radiation is applied over the retroreflective strip 138.

Figure 16:
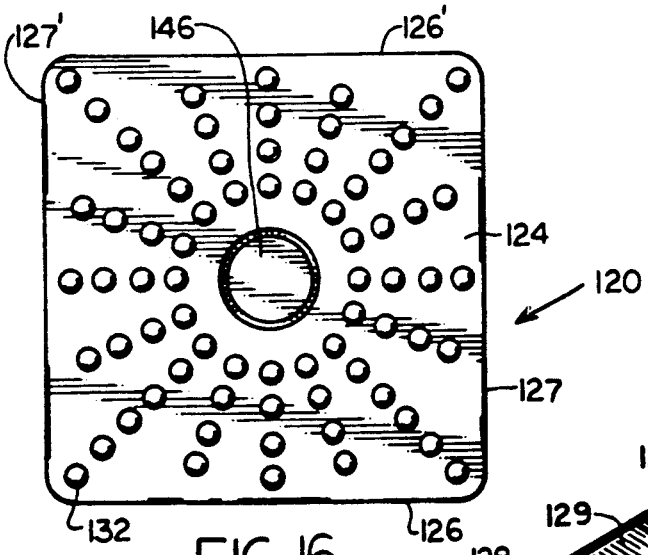
FIG. 16 is a bottom plan view.

The bottom plan view of FIG. 16 shows circular studs 132 that extend downwards from the base 124 and a depression 146 in the base 124 to provide a surface for adherence of the pavement adhesive to bond the marker 120 to the pavement. The shallow depression 146 in the middle of the base 124 allows a space for flow of excess pavement adhesive and to further enhance the adhesion.

It may be appreciated that the marker 120 of FIGS. 12 through 17 shares with the marker 30 of FIGS. 1 through 6 the advantages of a low profile design that provides adequate but not excessive auditory and tactile feedback to a driver when the vehicle wheels pass over the marker. In addition the marker 120 provides, as does the marker 30, protection from upwelling adhesive, used to bond the marker 120 to the pavement, that might otherwise obscure the retroreflective strip 138.

Figure 18:
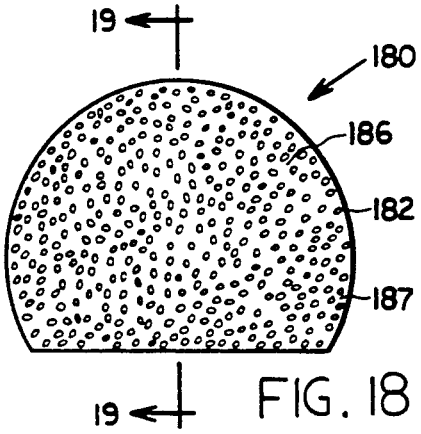
FIG. 18 is a top plan view of another embodiment in accordance with another preferred embodiment of the present invention.
Figure 19:
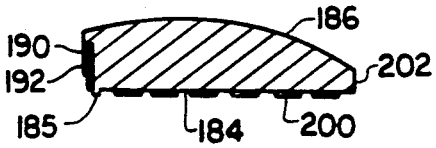
FIG. 19 is a sectional view along the line 19—19 of FIG. 18.

FIG. 18 is a top plan view, in accordance with another embodiment of the present invention, showing the marker 180 having a body 182. FIG. 19 is a sectional view along the line 19—19 of FIG. 18 illustrating a tab 185 that descends from the wall 190. The tab 185 extends below the base 184 substantially as far as do the studs 200. Attached to the wall 190 is the retroreflective strip 192. The tab 185 forms a barrier to keep the adhesive, used to bond the marker 180 to the pavement, from welling upward and obscuring the retroreflective strip 192. All other features and advantages of the marker 180 are the same as the marker 30 described above.

As illustrated in FIG. 18, the upper surface 186 of the marker 180 may have micro glass spheres 187 embedded therein for retroreflection of incident light. This may be in place of or in addition to the cap 54 shown in FIG. 2 for the marker 30. It should be appreciated by one skilled in the art that the feature of embedded micro glass spheres 187, as shown in FIG. 18, may be applied to any embodiment of the invention and, in particular to the upper surface 36 of the marker 30 (FIG. 1), the upper surface 76 of the marker 70 (FIG. 7), and the upper surface 128 of the marker 120 (FIG. 12).

Figure 20:
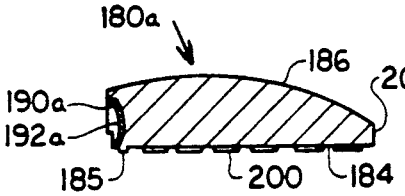
FIG. 20 is similar to FIG. 19 illustrating a concave strip.
Figure 21:
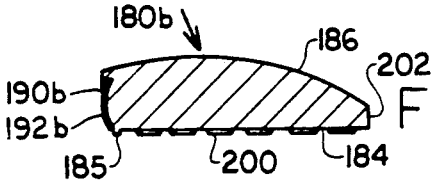
FIG. 21 is similar to FIG. 19 illustrating a convex strip.

FIG. 19 illustrates the flat wall 190 of the marker 180 and the attached retroreflective strip 192. FIG. 20 is a similar view to FIG. 19 illustrating, in accordance with another embodiment of the present invention, a marker 180*a* having a concave wall 190*a* with an attached retrorefective strip 192*a*. FIG. 21 is a similar view to FIG. 19 illustrating, in accordance with another embodiment of the present invention, a marker 180*b* having a convex wall 190*b* with an attached retrorefective strip 192*b*. The curvature of the retroreflective strips 192*a*, 192*b* allows them to be optimized for applications where it is desirable to reflect all or some of the impinging light and/or lights back to its source or sources and to nearby its source or sources which may vary in vertical angle of incidence. The markers 180*a* and 180*b* are otherwise identical to the marker 180.

Figure 22:
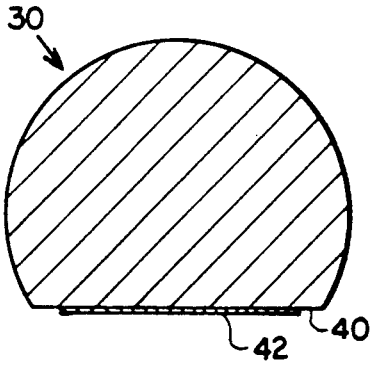
FIG. 22 is a sectional view along the line 22—22 of FIG. 4.
Figure 24:
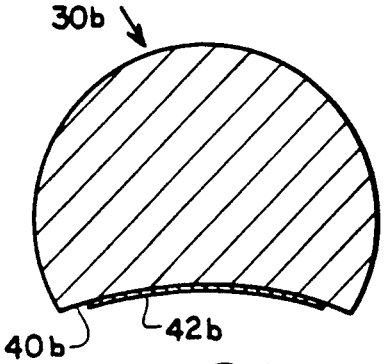
FIG. 24 is similar to FIG. 22 illustrating a convex strip.
Figure 23:
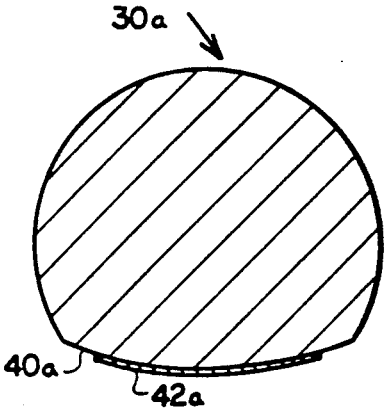
FIG. 23 is similar to FIG. 22 illustrating a concave strip.

FIG. 22 is a view along the line 22—22 of FIG. 4 showing the flat wall 40 of the marker 30 and the attached retroreflective strip 42. FIG. 23 is a similar view to FIG. 22 showing, in accordance with another embodiment of the present invention, a marker 30*a* having a convex wall 40*a* with an attached retroreflective strip 42*a*. FIG. 24 is a similar view to FIG. 22 illustrating, in accordance with another embodiment of the present invention, a marker 30*b* having a concave wall 40*b* with an attached retroreflective strip 42*b*. The curvature of the retroreflective strips 42*a*, 42*b* and the retroreflective strips 192*a*, 192*b* (FIGS. 20, 21) allows optimization for applications where the the light source location is moving as in an airplane where the illumination lights may be changing in attitude and/or azimuth during takeoffs, landings or taxying or as in a car when traversing a hill or curve. The markers 30*a* and 30*b* are otherwise identical to the marker 30.

FIG. 25 is a perspective view, in accordance with another embodiment of the present invention, of a marker 220. FIG. 26 is a top plan view, FIG. 27 is a front elevation view, FIG. 28 is a side elevation view, and FIG. 29 is a bottom plan view of the marker 220. FIG. 30 is a sectional view of the marker 220 along the line 30—30 of FIG. 26. The marker 220 is similar to the marker 120 (FIG. 12). However, the marker 220 is seen in FIG. 26 to additionally have, in its ramp 130' an indentation 134' that extends inward from the side 126' and terminates in a substantially vertical wall 136'. The wall 136' is best seen in FIG. 30.

As seen in FIG. 30, a retroreflective strip 138' is bonded to the wall 136'. A floor 144' fills the bottom of the indentation 134' and declines gradually from the wall 136' to the side 126'. The gradual decline of the floor 144' away from the vertical wall 136' insures that moisture and debris will not accumulate adjacent to the retroreflective strip 138'. A visor 142' extends outward from the upper surface 128 over the retroreflective strip 138' to protect the strip from tire abrasion. Clear coating 140' for protection from moisture and UV radiation is applied over the retroreflective strip 138'. All other features and advantages of the marker 220 are the same as the marker 120 described above.

It may be appreciated that the marker 220 shares with the marker 70 (FIG. 7) the night time retroreflective qualities of opposing substantially vertical retroreflective strips 138, 138' for use in situations having two way traffic conditions, the tire abrasion protection of visors 142, 142', and the daytime reflective properties of a high glaze upper surface 128, ramps 130, 130' and sides 126, 126', 127, 127'. In addition the smooth low profile of the upper surface 128, contiguous visors 142, 142' and ramps 130, 130' provides the same adequate but not excessive auditory and tactile feedback to the vehicle driver when his wheels pass over the marker 220.

Thus the marker 220 of FIGS. 25 through 30 shares with the marker 70 of FIGS. 7 through 11 the advantage of retroreflective strips 138, 138' facing in opposing directions for two way traffic flow in addition to including the other features and advantages of the marker 30 of FIGS. 1 through 6 which have previously been described.

It should be appreciated by one skilled in the art that the feature of a concave or convex wall, along the line 19—19 of FIG. 18, may be applied to any embodiment of the invention and, in particular to the marker 30 (FIG. 1), the marker 70 (FIG. 7), the marker 120 (FIG. 12) and the marker 220 (FIG. 25). It should also be appreciated that the feature of a concave or convex wall, along the line 22—22 of FIG. 4, may be applied to any embodiment of the invention and, in particular to the marker 70 (FIG. 7), the marker 120 (FIG. 12), the marker 180 (FIG. 18) and the marker 220 (FIG. 25).

Figure 31:
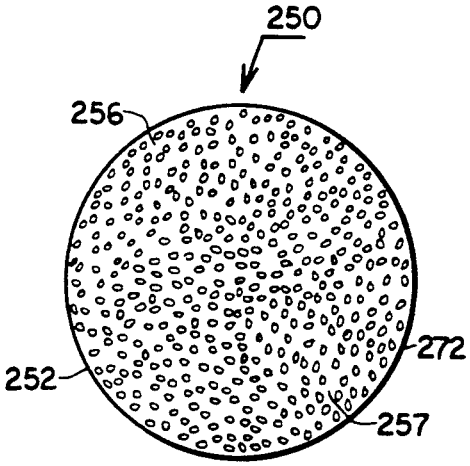
FIG. 31 is similar to FIG. 18 illustrating another embodiment without a retroreflective strip.

FIG. 31 is a top plan view similar to FIG. 18 illustrating the marker 250 in accordance with another embodiment of the present invention. The marker 250 has micro glass spheres 257 embedded in its upper surface 256 for retroreflection of incident light. This may be in place of or in addition to the cap 54 shown in FIG. 2 for the marker 30.

The marker 250 does not have its side 272 or upper surface 256 terminated by a vertical wall as in the vertical wall 190 of marker 180 (shown in FIG. 19). The marker 250 also does not have a retroreflective strip similar to the retroreflective strip 192 of the marker 180 (as shown in FIG. 19). The marker 250 also does not have a tab similar to the tab 185 of marker 180 (shown in FIG. 19) nor a lip similar to the lip 48 of marker 30 (shown in FIG. 1). All other features and advantages of the marker 250 are the same as the marker 30 described above.

Although the present invention has been described with reference to preferred embodiments, numerous modifications and rearrangements can be made with the equivalent result still embraced within the scope of the invention.

What is claimed is:

1. A low profile pavement marker for bonding to a pavement with adhesive, comprising:

a body having a base, an upper surface rising from said base, and a substantially vertical wall descending from said upper surface;

a retroreflective strip bonded to said wall; and a lip bonded to said base and extending past said wall, the adhesive thereby prevented from obscuring said retroreflective strip.

2. A marker as defined in claim 1 wherein said base has a plurality of descending studs and a central depression for adherence of the adhesive.

3. A marker as defined in claim 1 also comprising a plurality of glass spheres embedded in said upper surface thereby retroreflecting from said upper surface incident light to its source and/or sources and to nearby its source and/or sources.

4. A marker as defined in claim 1 also comprising a visor extending from said upper surface over said wall wherein said upper surface and said visor are smoothly contoured thereby inducing non injurious vibration to overpassing vehicle wheels.

5. A marker as defined in claim 1 wherein said upper surface has a high glaze so as to maximize scattering of incident light.

6. A marker as defined in claim 1 also comprising a resilient cap bonded to or as an integral part of said upper surface, said cap having embedded glass spheres, said cap thereby adding shock protection to said marker and said spheres thereby retroreflecting incident light to its source and/or sources and to nearby its source and/or sources.

7. A marker as defined in claim 1 wherein said wall has a curvature relative to the center of said body.

8. A marker as defined in claim 1 wherein said strip is bonded to said wall by means of a pressure sensitive glue between said strip and said wall and further comprising a clear coating having an ultraviolet inhibitor, said coating applied over said retroreflective strip and said wall, said retroreflective strip and said glue thereby protected from moisture and ultraviolet radiation.

9. A low profile pavement marker for bonding to a pavement with adhesive, comprising:

a body having a base, an upper surface rising from said base, and a substantially vertical wall descending from said upper surface;

a retroreflective strip bonded to said wall; and a tab descending from said wall, the adhesive thereby prevented from obscuring said retroreflective strip.

10. A marker as defined in claim 9 also comprising a resilient cap bonded to or as an integral part of said upper surface, said cap having embedded glass spheres, said cap thereby adding shock protection to said marker and said spheres thereby retroreflecting incident light to its source and/or sources and to nearby its source and/or sources.

11. A marker as defined in claim 9 wherein said wall has a curvature relative to the center of said body.

12. A marker as defined in claim 9 wherein said strip is bonded to said wall by means of a pressure sensitive glue between said strip and said wall and further comprising a clear coating having an ultraviolet inhibitor, said coating applied over said retroreflective strip and said wall, said retroreflective strip and said glue thereby protected from moisture and ultraviolet radiation.

13. A marker as defined in claim 9 wherein said base has a plurality of descending studs and a central depression for adherence of the adhesive.

14. A marker as defined in claim 9 also comprising a plurality of glass spheres embedded in said upper surface thereby retroreflecting from said upper surface incident light to its source and/or sources and to nearby its source and/or sources.

15. A marker as defined in claim 9 wherein said upper surface is smoothly contoured thereby inducing non injurious vibration to overpassing vehicle wheels.

16. A marker as defined in claim 9 wherein said upper surface has a high glaze so as to maximize scattering of incident light.

17. A low profile pavement marker for bonding to a pavement with adhesive, comprising:

a body having a base, an upper surface rising from said base, and a substantially vertical wall descending from said upper surface;

a retroreflective strip abutting said wall.

18. A marker as defined in claim 17 also comprising a resilient cap bonded to or as an integral part of said upper surface, said cap having embedded glass spheres, said cap thereby adding shock protection to said marker and said spheres thereby retroreflecting incident light to its source and/or sources and to nearby its source and/or sources.

19. A marker as defined in claim 17 wherein said wall has a curvature relative to the center of said body.

20. A marker as defined in claim 17 wherein said base has a plurality of descending studs and a central depression for adherence of the adhesive.

21. A marker as defined in claim 17 also comprising a plurality of glass spheres embedded in said upper surface thereby retroreflecting from said upper surface incident light to its source and/or sources and to nearby its source and/or sources.

22. A marker as defined in claim 17 wherein said upper surface is smoothly contoured thereby inducing non injurious vibration to overpassing vehicle wheels.

23. A marker as defined in claim 17 wherein said upper surface has a high glaze so as to maximize scattering of incident light.

24. A low profile pavement marker for bonding to a pavement with adhesive, comprising;

a body having a base, an upper surface rising from said base, a substantially vertical wall descending from said upper surface and a visor extending from said upper surface over said wall;

a retroreflective strip bonded to said wall; and a resilient cap bonded to or as an integral part of said upper surface adjacent said visor, said cap thereby adding shock protection to said marker.

25. A marker as defined in claim 24 wherein at least one said wall has a curvature relative to the center of said body.

26. A marker as defined in claim 24 wherein said strip is bonded to said wall by means of a pressure sensitive glue between said strip and said wall and further comprising a clear coating having an ultraviolet inhibitor, said coating applied over said retroreflective strip and said wall, said retroreflective strip and said glue thereby protected from moisture and ultraviolet radiation.

27. A marker as defined in claim 24 wherein said base has a plurality of descending studs and a central depression for adherence of the adhesive.

28. A marker as defined in claim 24 also comprising a plurality of glass spheres embedded in said upper surface thereby retroreflecting from said upper surface incident light to its source and/or sources and to nearby it source and/or sources.

29. A marker as defined in claim 24 wherein said upper surface and said visor are smoothly contoured thereby inducing non injurious vibration to overpassing vehicle wheels.

30. A marker as defined in claim 24 wherein said upper surface has a high glaze so as to maximize scattering of incident light.

31. A low profile pavement marker for bonding to a pavement with adhesive, comprising:

a body having a base, an upper surface rising from said base, and a substantially vertical wall descending from said upper surface; and a retroreflective strip bonded to said wall;

wherein said wall and attached said retroreflective strip define a curved surface relative to the center of said body, said retroreflective strip thereby retroreflecting incident light from a source and/or sources which may move or be varied vertically and/or horizontally.

32. A marker as defined in claim 31 also comprising a resilient cap bonded to or as an integral part of said upper surface, said cap having embedded glass spheres, said cap thereby adding shock protection to said marker and said spheres thereby retroreflecting incident light to its source and/or sources and to nearby its source and/or sources.

33. A marker as defined in claim 31 wherein said strip is bonded to said wall by means of a pressure sensitive glue between said strip and said wall and further comprising a clear coating having an ultraviolet inhibitor, said coating applied over said retroreflective strip and said wall, said retroreflective strip and said glue thereby protected from moisture and ultraviolet radiation.

34. A marker as defined in claim 31 wherein said base has a plurality of descending studs and a central depression for adherence of the adhesive.

35. A marker as defined in claim 31 also comprising a plurality of glass spheres embedded in said upper surface thereby retroreflecting from said upper surface incident light to its source and/or sources and to nearby its source and/or sources.

36. A marker as defined in claim 31 wherein said upper surface is smoothly contoured thereby inducing non injurious vibration to overpassing vehicle wheels.

37. A marker as defined in claim 31 wherein said upper surface has a high glaze so as to maximize scattering of incident light.

38. A marker as defined in claim 31 wherein said curved surface is convex.

39. A marker as defined in claim 31 wherein said curved surface is concave.

40. A low profile pavement marker for bonding to a pavement with adhesive, comprising:

a body having a substantially circular flat base, and upper surface rising from said base, a substantially vertical wall descending from said upper surface, a visor extending from said upper surface over said vertical wall and a plurality of studs descending from said base and a central depression in said base for adherence of the adhesive, said upper surface and said visor smoothly contoured thereby inducing non-injurious vibration to overpassing vehicle wheels;

a retroreflective strip bonded to said wall, said retroreflective strip thereby protected from tire abrasion by said visor;

a clear coating having an ultraviolet inhibitor, said coating applied to said retroreflective strip, said retroreflective strip thereby protected against moisture and ultraviolet radiation; and a lip bonded to said base and extending past said vertical wall, the adhesive thereby prevented from obscuring said retroreflective strip;

said upper surface thereby scattering incident light and said retroreflective strip thereby retroreflecting incident light to its source and/or sources and to nearby its source and/or sources when said base is mounted with adhesive to the pavement.

41. A marker as defined in claim 40 wherein said vertical wall and attached said retroreflective strip are convex relative to the center of said body, said retroreflective strip thereby retroreflecting incident light from a source or sources which may move or be varied vertically and/or horizontally.

42. A marker as defined in claim 40 wherein said vertical wall and attached said retroreflective strip are concave relative to the center of said body, said retroreflective strip thereby retroreflecting incident light from a source or sources which may move or be varied vertically and/or horizontally.

43. A marker as defined in claim 40 also comprising a resilient cap bonded to or as an integral part of said upper surface adjacent said visor, said cap having embedded glass spheres, said cap thereby adding shock protection to said marker and said spheres thereby retroreflecting incident light to its source and/or sources and to nearby its source and/or sources.

44. A marker as defined in claim 40 also comprising a plurality of glass spheres embedded in said upper surface thereby retroreflecting from said upper surface incident light to its source and/or sources and to nearby its source and/or sources.

45. A low profile pavement marker for bonding to a pavement with adhesive, comprising:

a body having an elongated flat base with semi-circular ends, an upper surface rising from said base, a substantially vertical first wall and a substantially vertical second wall descending from said upper surface, said walls facing substantially one hundred eighty degrees away from each other, a first visor and a second visor extending from said upper surface, said first visor extending over said first wall, said second visor extending over said second wall and a plurality of studs descending from said base and a central despression in said base for adherence of the adhesive, said upper surface and said visors smoothly contoured thereby inducing non-injurious vibration to overpassing vehicle wheels;

a first retroreflective strip bonded to said first wall, said first retroreflective strip thereby protected from tire abrasion by said first visor;

a second retroreflective strip bonded to said second wall, said second retroreflective strip thereby protected from tire abrasion by said second visor;

a clear coating having an ultraviolet inhibitor, said coating applied to said first and said second retroreflective strips, said first and said second retroreflective strips thereby protected against moisture and ultraviolet radiation;

a first lip bonded to said base and extending past said vertical first wall, the adhesive thereby prevented from obscuring said first retroreflective strip; and a second lip bonded to said base and extending past said vertical second wall, the adhesive thereby prevented from obscuring said second retroreflective strip;

said upper surface thereby scattering incident light and said first and said second retroreflective strip thereby retroreflecting incident light to its source and/or sources and to nearby its source and/or sources when said base is mounted with adhesive to the pavement.

46. A marker as defined in claim 45 wherein said first wall and attached said first retroreflective strip and said second wall and attached said second retroreflective strip are convex relative to the center of said body, said first and second retroreflective strips thereby retroreflecting incident light from a source or sources which may move or be varied vertically and/or horizontally.

47. A marker as defined in claim 45 wherein said first wall and attached said first retroreflective strip and said second wall and attached said second retroreflective strip are concave relative to the center of said body, said first and second retroreflective strips thereby retroreflecting incident light from a source or sources which may move or be varied vertically and/or horizontally.

48. A marker as defined in claim 45 also comprising a resilient cap bonded to or as an integral part of said upper surface adjacent said visor, said cap having embedded glass spheres, said cap thereby adding shock protection to said marker and said spheres thereby retroreflecting incident light to its source and/or sources and to nearby its source and/or sources.

49. A marker as defined in claim 45 also comprising a plurality of glass spheres embedded in said upper surface thereby retroreflecting from said upper surface incident light to its source and/or sources and to nearby its source and/or sources.

* * * * *